US007138215B2

(12) United States Patent
Oya et al.

(10) Patent No.: US 7,138,215 B2
(45) Date of Patent: Nov. 21, 2006

(54) PROCESS CARTRIDGE, IMAGE FORMING APPARATUS AND IMAGE FORMING METHOD

(75) Inventors: Yasuhiro Oya, Minamiashigara (JP); Tomohiro Takeda, Minamiashigara (JP); Daisuke Ishizuka, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 174 days.

(21) Appl. No.: 10/733,453

(22) Filed: Dec. 12, 2003

(65) Prior Publication Data

US 2004/0259016 A1 Dec. 23, 2004

(30) Foreign Application Priority Data

Jun. 20, 2003 (JP) ..... 2003/176385
Jun. 20, 2003 (JP) ..... 2003/177210

(51) Int. Cl.
*G03G 13/16* (2006.01)
*G03G 15/00* (2006.01)

(52) U.S. Cl. ..... 430/110.1; 430/111.4; 430/120; 399/262; 399/111; 399/119

(58) Field of Classification Search ..... 430/110.1, 430/111.4, 120; 399/262, 111, 119
See application file for complete search history.

(56) References Cited

U.S. PATENT DOCUMENTS 6,671,476 B1 * 12/2003 Saiki ..... 399/111
6,733,945 B1 * 5/2004 Hirota et al. ..... 430/125

FOREIGN PATENT DOCUMENTS

| | | |
|---|---|---|
| JP | A 1-276174 | 11/1989 |
| JP | B2 6-12475 | 2/1994 |
| JP | A 10-177275 | 6/1998 |
| JP | A 2002-40787 | 2/2002 |
| JP | A 2002-72545 | 3/2002 |
| JP | A 2002-169329 | 6/2002 |

* cited by examiner

*Primary Examiner*—Mark A. Chapman
(74) *Attorney, Agent, or Firm*—Oliff & Berridge, PLC

(57) ABSTRACT

The present invention provides a process cartridge that is freely attachable to and detachable from a main body of an image forming apparatus and that includes a latent image bearing body and a developing device having a developer storage space for storing a developer, the image forming apparatus and an image forming method. The invention also provides another image forming method using a one-component magnetic toner that is employable in a wide region of from a low process speed to a high process speed while achieving a high fixing ability.

15 Claims, 4 Drawing Sheets

PROCESS CARTRIDGE, IMAGE FORMING APPARATUS AND IMAGE FORMING METHOD

CROSS-REFERENCE TO RELATED APPLICATION

This application claims priority under 35 USC 119 from Japanese Patent Application Nos. 2003-176385 and 2003-177210, the disclosures of which are incorporated by reference herein.

BACKGROUND OF THE INVENTION

1. Field of the Invention

The present invention relates to an image forming apparatus such as a copying machine or printer, and particularly to an image forming apparatus and image forming method in which latent images on an image bearing body are made visible with a developer, and a process cartridge used therefor. The invention also relates to an image forming method using a one-component magnetic toner.

2. Description of the Related Art

A number of electrophotographic processes are known in the art. In the electrophotographic process, a fixed image is formed through a plurality of steps comprising electrically forming a latent image by various methods on an electrostatic latent image bearing body utilizing a photoconductive material, developing the latent image using a developer containing a toner, transferring the toner latent image on the electrostatic latent image bearing body onto a transfer body such as a sheet of paper with or without interposition of an intermediate transfer body, and fixing the latent image by heating, compressing or heating with compression, or with a vapor of a solvent. If necessary, toner remaining on the latent image bearing body is cleaned off by various methods, and the aforementioned plural steps are repeated. Printers and copying machines utilizing the electrophotographic process are widely used, and accordingly, requirements with respect to performance and image quality are become more strict year by year.

Developing methods for the electrophotographic process are divided into one-component developing methods and two-component developing methods. While the two-component developing method has widely been used for development since it is advantageous for high speed processing, it involves disadvantages such as deterioration of the developer due to adhesion of the toner on the surface of a carrier and a large size of the developing device since the mixing ratio of the toner to the carrier should be kept constant so that the toner concentration in the developer does not decrease due to only the toner being consumed in this method. Consequently, the cost of controlling the toner density becomes high. On the other hand, since the one-component developing method is advantageous in that the device is compact and the cost may be reduced without producing the above-mentioned defects, the device is prevalent in small offices and in the field of personal users.

The one-component developing method is roughly divided into a non-magnetic one-component developing method and magnetic one-component developing method. The former is suitable for color printing because the toner does not contain magnetic powders. On the other hand, the magnetic one-component developing method is frequently used in a monochromatic electrostatic copying method since the toner can be retained on the toner bearing body using a magnetic force of the magnetic powder contained in the toner, and from the viewpoints of good conveying ability of the toner and easily inhibition of fogging of the toner at non-image portions.

The one-component developing method is more suitable for making the apparatus compact as compared with the two-component developing method. However, while so-called long life is urgently required for increasing the number of printing sheets (the number of copying sheets) per process cartridge in addition to the requirement for more compactness in recent years, a space for accommodating the developer is further reduced by making the process cartridge small. Consequently, the number of printing or copying sheets printed or copied before the toner in the cartridge has been depleted is reduced. Therefore, various methods have been devised for satisfying requirements of both small size and long life.

For example, a compact apparatus has been realized by disposing the developing section, exposing section and cleaning section at the same side relative to a vertical face intersecting the center of rotation of the image bearing body in the process cartridge used for the image forming apparatus disclosed in Japanese Patent Application Publication (JP-B) No. 6-12475. Further, Japanese Patent Application Laid-Open (JP-A) No. 2002-040787 discloses a method in which the developing device is made compact by simplifying the construction thereof in order to ensure a sufficient space for accommodating the developer. However, there has been a problem in that undeveloped developer remains in a dead space in the cartridge.

In order to reduce the size, and particularly the width, of the apparatus, it has been proposed to arrange a recording medium path from a transferring step to a fixing step in a substantially vertical direction to discharge the recording medium at the upper portion of the apparatus instead of discharging the recording medium to the side of the apparatus. However, since a developing device is positioned below a scanning light path in a process cartridge image forming apparatus such as described above, the size of the developing device must be small for reducing the height of the apparatus. Since the developing device is equipped with a developer storage portion for storing the developer, the size of the developer storage portion is inevitably small, whereby it is difficult to reduce the size of the apparatus with the volume of the developer storage portion unchanged.

It is also a drawback of the one-component developing method that toner conveyability onto the toner bearing body is likely to be unstable and distribution of electric charges of the toner tends to be broadened, since a charge donating ability, a developer conveying ability, and a developer stirring ability of the carrier cannot be utilized in this method. Consequently, development ghosts, fogging of the toner at non-image portions, and a decrease in development density are liable to occur. Since a darker black hue is required than conventionally from the viewpoint of improving image quality, higher image density is demanded. On the other hand, the foregoing problems are more liable to occur due to making members such as the toner bearing body compact in accordance with the trend toward a small-sized apparatus, due to shortening the charging time and developing time for high speed processing, and due to reducing the charge amount per toner particle in accordance with a reduced particle size of the toner for obtaining high quality images.

A variety of proposals have been made to solve the aforementioned problems.

It has been found that a development ghost could usually be removed using a method for suppressing charge-up of the toner. In a technology utilizing the above-described discovery, electrical resistance of the developer holding member (sleeve) is reduced to lower the absolute value of the toner charge by providing, for example, a resin layer comprising a phenol resin and carbon and having electrical conductivity and surface lubricity, on the toner bearing body in order to prevent a development ghost from occurring (e.g., see JP-A No. 1-276174). However, developing ability from the developer bearing body to a latent image bearing body (photoreceptor) may be deteriorated by reducing the charge amount of the toner, resulting in a decrease in image density. Since the charge amount per toner particle has been reduced in recent years by forming toner with a smaller particle diameter for complying with the requirement of high image quality, fogging is liable to occur. In another method disclosed, for example, in JP-A No. 10-177275, a developer bearing body having on its surface a film that contains Mo, O and H as main components is used, and a titanium compound obtained by a reaction between $TiO(OH)_2$ and a silane compound is added to a magnetic one-component developer. A layer of toner transferred onto the bearing body is made uniform using the developer bearing body having the Mo-based material, and a ghost is prevented from being generated by utilizing a rapid charge exchanging property by adding the titanium-based compound. This method is quite effective. However, in a contact type transferring system, an electric field may affect the toner since the titanium-based compound as an additive has a relatively low electrical resistance to thereby reduce transferring efficiency and image density. These phenomena are apt to occur in a high temperature/high humidity environment and in a low speed machine having a long transferring time. Transferring ability is also liable to be impaired due to a decrease of the charge amount resulting from reduction of the particle diameter as described above. Further, the amount of the residual toner on the latent image bearing body is certain to increase, even when impaired transferring ability causes no problem with respect to image quality. Thus, further improved transferring efficiency is required from the viewpoint of reducing the amount of wasted toner.

With respect to deterioration of the transferring ability due to the electric field, a technique has been proposed in which the transferring ability may be improved at a process speed below 120 mm/s by optimizing a change in the resistance of the toner (e.g., see JP-A No. 2002-169329). However, in such a one-component magnetic toner, when the process speed exceeds 120 mm/s, worsening of a development ghost and a decrease in image density, due to high resistance of the toner as a result of speeding-up of the process, becomes more prominent than the transferring ability improving effect. Further, when the development electric field is increased to obtain higher image density, an increase in the process speed is accompanied by an increase in toner that contributes to fogging. Therefore, compatibility of transferability and developing ability is a current issue.

As a toner capable of complying with high speed processing, a toner has been proposed, which uses a magnetic powder whose magnetic property, fluidity, environmental stability and resistance can be adjusted by a composite oxide film of aluminum and iron, and which does not reduce the blackness of the toner (see, for example, JP-A No. 2002-72545). When the magnetic powder is used in the magnetic toner, excellent developing ability and transferability can be achieved by decreasing the content of the magnetic powder in the toner in a low process speed region below 120 mm/s. On the other hand, the toner can effectively be used when the process speed exceeds 120 mm/s by increasing a content of the magnetic powder depending on the process speed and using an additive having a relatively low resistance such as a titanium-based additive. However, even if such a means is adopted, the content of the magnetic powder must be adjusted depending on the process speed, and currently available one-component magnetic toners cannot satisfy all of the properties such as developing ability and transferability in a region of from a low speed (120 mm/s or less) to a high speed (up to 250 mm/s) when one kind of toner is used.

Moreover, the fixing ability of the toner is not sufficient when the process speed is 180 mm/s or more and a heating time for fixing is shortened. From this standpoint as well, conventionally known one-component magnetic toners cannot exhibit sufficient ability in the region of from a low speed (120 mm/s or less) to a high speed (up to 250 mm/s) when one kind of toner is used.

SUMMARY OF THE INVENTION

In view of the foregoing circumstances, the present invention was accomplished to solve the problems of the prior art.

Therefore, it is an object of the invention to provide a process cartridge, an image forming apparatus and an image forming method that ensure a developer storage capacity without reducing a space for the developer in the developing device while providing both long life and a small apparatus size, and that can also maintain a stable image quality.

Another object of the invention is to provide an image forming method using a one-component magnetic toner that exhibits a high transferring efficiency in a low process speed region as well as a high image density in a high process speed region without producing a development ghost, and that is employable in a wide region of from a low process speed to a high process speed, while achieving a high fixing ability.

A first aspect of the invention is to provide a process cartridge which is freely attachable to and detachable from a main body of an image forming apparatus, the process cartridge comprising a latent image bearing body and a developing device having a developer storage space for storing a developer, wherein the developer storage space is divided into a first developer storage portion and a second developer storage portion in a vertical direction such that a latent image writing position of the latent image bearing body is interposed between the first developer storage portion and the second developer storage portion, the first developer storage portion and the second developer storage portion communicate with each other through a developer path, and the developer has a compression ratio in a range of 0.30 to 0.40.

A second aspect of the invention is to provide an image forming apparatus which comprises a main body and a process cartridge that is freely attachable to and detachable from the main body, the process cartridge comprising a latent image bearing body and a developing device having a developer storage space for storing a developer, wherein the developer storage space is divided into a first developer storage portion and a second developer storage portion in a vertical direction such that a latent image writing position of the latent image bearing body is interposed between the first developer storage portion and the second developer storage portion, the first developer storage portion and the second developer storage portion communicate with each other through a developer path, and the developer has a compression ratio in a range of 0.30 to 0.40.

A third aspect of the invention is to provide an image forming method which comprises the steps of: forming an electrostatic latent image on a surface of a latent image bearing body; developing the electrostatic latent image with a developer in a developing device; and transferring a developed toner image onto a transfer body, wherein, in the developing device, a developer storage space is divided into a first developer storage portion and a second developer storage portion in a vertical direction, and the first developer storage portion and the second developer storage portion communicate with each other through a developer path, and wherein the latent image forming step comprises writing the latent image through a gap between the first developer storage portion and the second developer storage portion, and the developer has a compression ratio in a range of 0.30 to 0.40.

A fourth aspect of the invention is to provide an image forming method which comprises the steps of: forming an electrostatic latent image on a surface of a latent image bearing body; developing the electrostatic latent image as a toner image with a developer in a developing device; and transferring the developed toner image onto a transfer body, wherein: the transferring step comprises applying a voltage while bringing a transfer member into contact with the transfer body; the toner comprises toner particles containing a binder resin, 35 to 55% by mass of a magnetic powder having a surface coating of a composite oxide of aluminum and iron, and a releasing agent, and 0.5 to 1.0% by mass of titanium oxide having an average primary particle diameter of 30 to 100 nm as an external additive; and a mixture prepared by mixing the toner with a carrier in a proportion of 4% by mass relative to the carrier is placed in the developing device, the mixture having a volume resistance of from $1\times10^{15}$ Ω·cm to $5\times10^{16}$ Ω·cm as measured when a direct current under a voltage of 500 V is applied using a magnetic brush.

Figure 1:
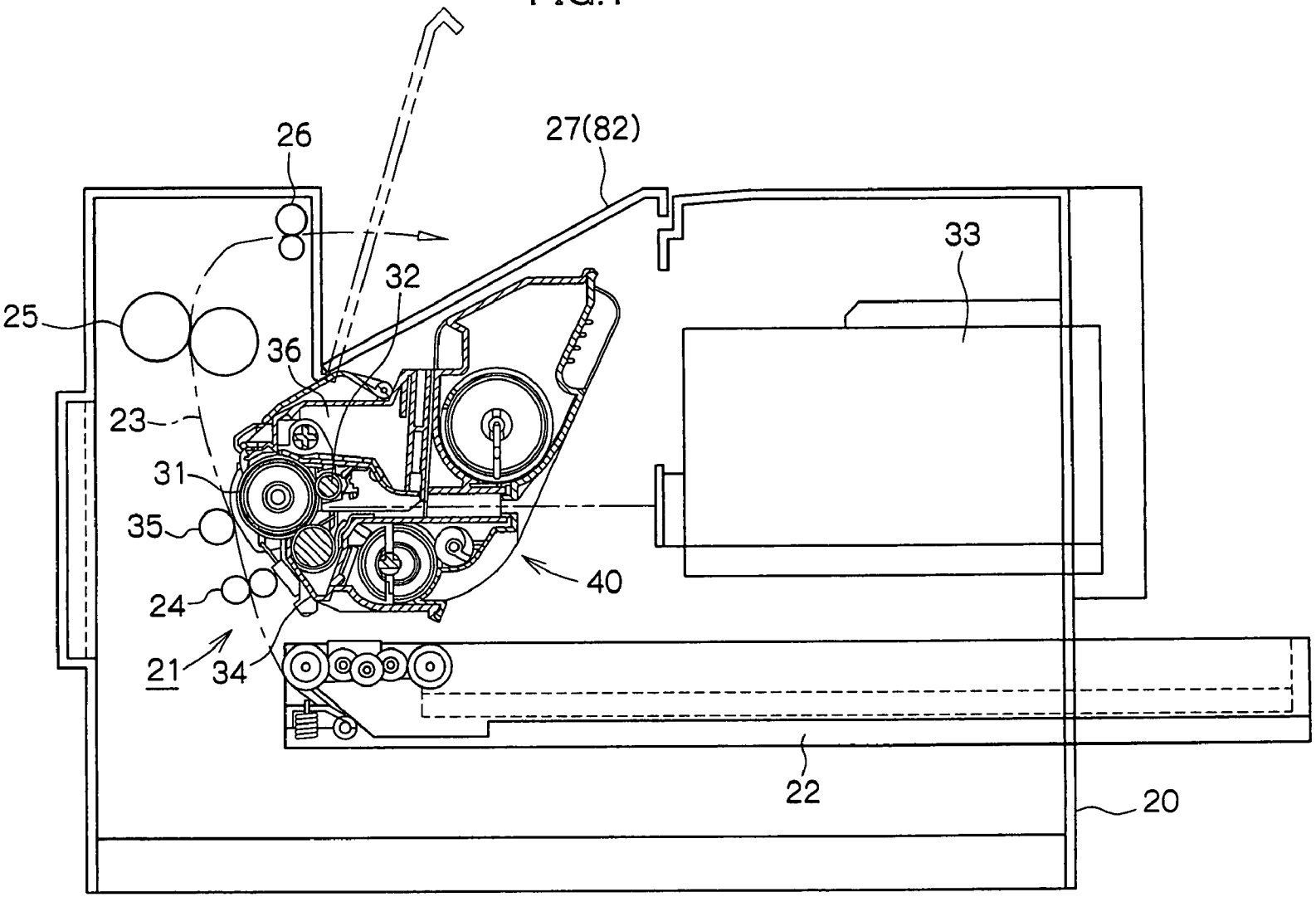
FIG. 1 is a cross sectional view showing an image forming apparatus relating to an embodiment of the present intention.

DESCRIPTION OF THE PREFERRED EMBODIMENTS (A) First, description will be made of a process cartridge according to a first aspect of the present invention, an image forming apparatus according to a second aspect of the invention, and an image forming method according to a third aspect of the invention.

It has been considered that making the developing device compact is inevitable for forming a small sized image forming apparatus as described above, while the amount of the developer is maintained or increased by forming a developer storage space with a given height in a vertical direction in the developing device for attaining long life. However, feeding of the toner to a developing part such as a developing roll is decreased due to deterioration of fluidity of the developer, which is called as a blocking phenomenon, at the bottom of the developer storage space due to the weight of the developer itself, when the amount of the developer is maintained or increased for attaining long life while the developer storage space has a given height. Such a construction will cause problems such as deterioration of developing ability.

Accordingly, the developer storage space of the developing device is vertically divided into two portions with interposition of a latent image writing position, and the divided developer storage spaces communicate with each other through a developer path. Then, a developer storage capacity is secured by the first developer storage portion even by reducing the developer storage capacity of the second developer storage portion beneath the latent image writing position. Consequently, the blocking phenomenon hardly occurs by feeding the developer stored in the first developer storage portion to the second developer storage portion through the developer path.

Excessive feeding of the developer from the first developer storage portion to the second developer storage portion, and clogging of the developer path connecting between the first developer storage portion and the second developer storage portion due to blocking may be prevented by adjusting the compression ratio of the developer in the range of 0.30 to 0.40 to thereby allow stable feeding of the developer.

Consequently, the developer storage capacity is maintained without reducing the developer space in the developing device. Long life may be attained together with a small sized apparatus while maintaining a stable image quality.

When a scanning laser exposure device is used as a means for forming the latent image, an window constituting the scanning light path may be formed between the first developer storage portion and the second developer storage portion in the developing device for ensuring the path of scanning light output from the scanning laser exposure device, and the first developer storage portion and the second developer storage portion may be vertically separated with interposition of this window. The developer path is preferably provided at both sides of the window.

A first stirring and conveying member for conveying the developer from the center to both sides with stirring is preferably provided in the first developer storage portion. While the first stirring and conveying member may be composed of a wire material or formed into a crank, it is preferably formed into a coil having different winding directions from the center in the vertical direction to both sides.

A second stirring and conveying member for conveying the developer from both sides to the center with stirring is also preferably provided in the second developer storage portion. This configuration renders a feeding amount of the developer to be uniform in the axial direction. However, there is not a need for the second stirring and conveying member to have a specific structure when fluidity of the developer is good, and the member may have a crank shape.

It is preferable if the toner in the developer contains 35 to 55% by weight of a magnetic powder, since an excellent image may be formed by stabilizing the image density and fogging even by compacting the apparatus.

The preferable embodiment of the present invention will be described with reference to the drawings. The members having substantially the same function are shown with the same reference numeral throughout the drawings.

Figure 2:
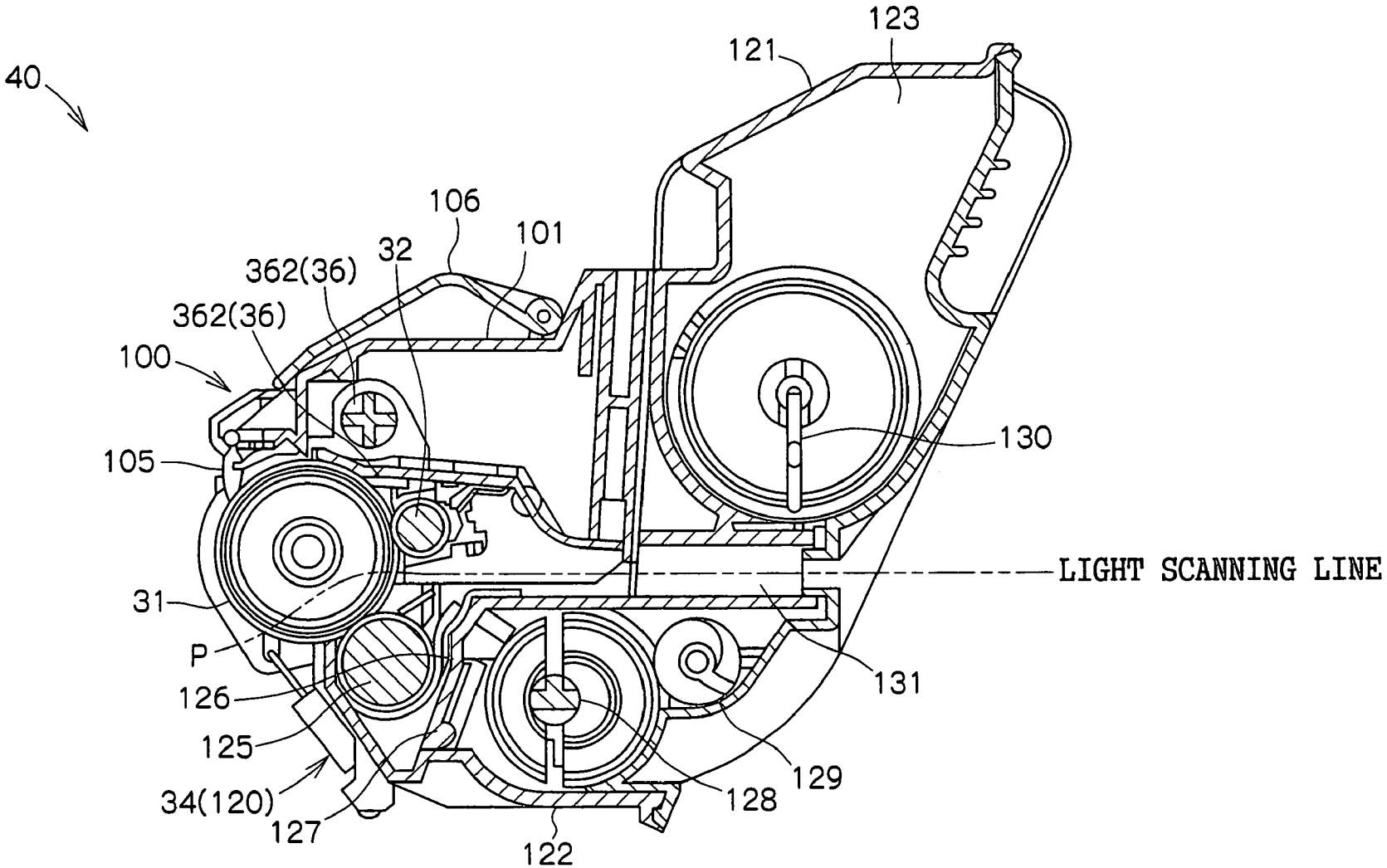
FIG. 2 is a cross sectional view showing a process cartridge relating to the embodiment of the intention.
Figure 3:
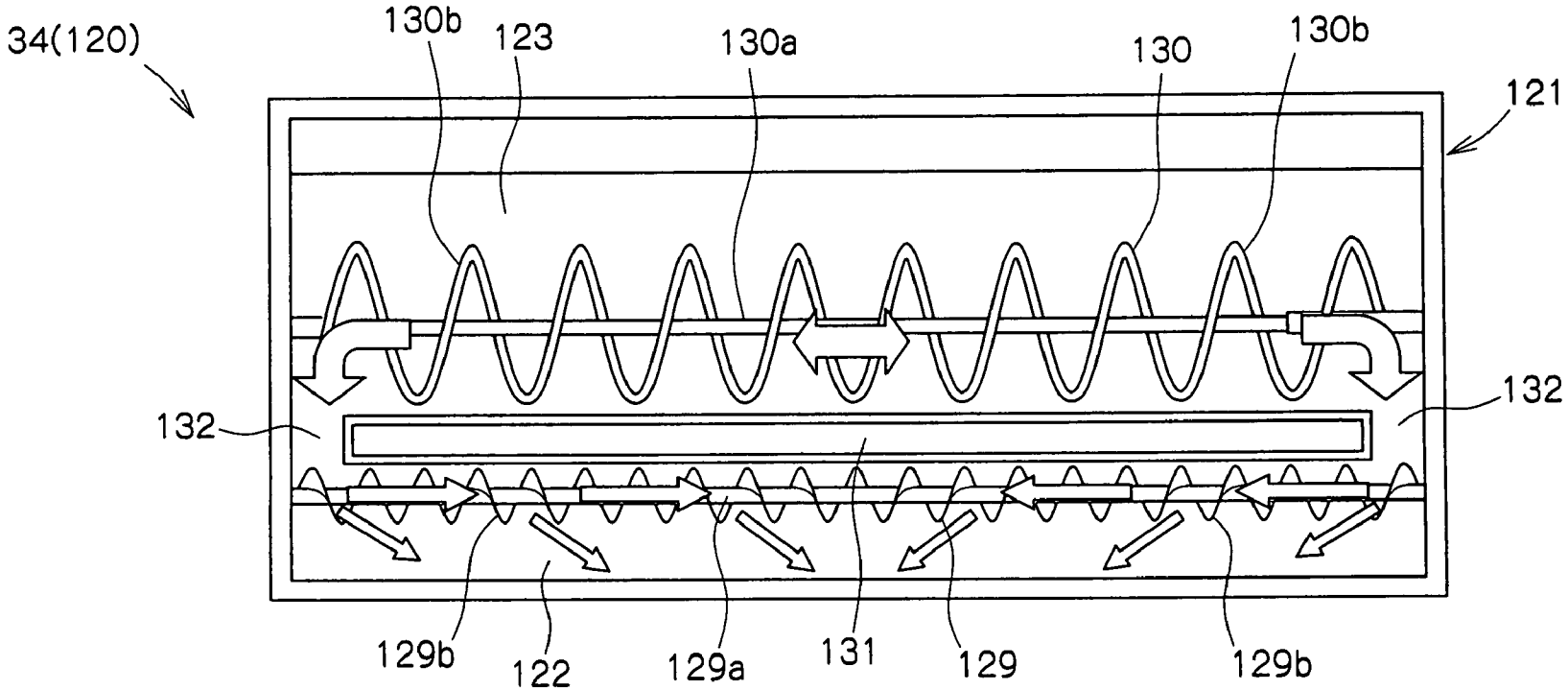
FIG. 3 is a front view showing a feeding path of a developer (toner) in the process cartridge relating to the embodiment of the intention.

FIG. 1 is a schematic view showing an entire construction of the image forming apparatus according to an embodiment of the invention. FIG. 2 is a schematic view showing the process cartridge according to an embodiment of the invention. FIG. 3 is a front view showing the feeding path of the developer in the process cartridge according to an embodiment of the invention.

The image forming apparatus of the embodiment of the invention is equipped with, for example, an electrophotographic image-forming engine 21 in the main body 20 of the device as shown in FIG. 1. A sheet feeding device 22 is provided beneath the image-forming engine 21 in the main body 20 while the upper portion of the main body 20 is constructed as a discharging tray 27. A sheet feeding path 23 is provided such that the sheet having been fed from the sheet feeding device 22 at the back side (left side in FIG. 1) of the main body 20 is guided to the image-forming engine 21 and discharging tray 27.

An electrophotographic method is employed, for example, in the image-forming engine 21, which comprises a photoreceptor drum 31, a charging device (an charging roll in this example) 32 for charging of the photoreceptor drum 31, an exposing device 33 such as a laser scanning unit for writing an electrostatic latent image (hereinafter referred to as a latent image) on the charged photoreceptor drum 31, a developing device 34 for developing the latent image on the photoreceptor drum 31 with a toner, a transferring device (a transferring roll in this example) 35 for transferring a visible image (a toner image) on the photoreceptor drum 31 onto a sheet, and a cleaning device 36 for cleaning the toner that remains on the photoreceptor drum 31.

A resist roll 24 for conveying the sheet with positioning is provided at an upstream of the photoreceptor drum 31 in the sheet conveying path 23, and a fixing device 25 is disposed at a downstream of the photoreceptor drum 31 in the sheet conveying path 23. A discharging roll 26 is arranged immediately before the discharging tray 27.

Most of the devices of the imaging engine 21 are integrated as a process cartridge 40. In other words, the process cartridge 40 incorporates the photoreceptor drum 31, the charging device 32, the developing device 34 and cleaning device 36 in a state to allow freely attachable and detachable to the main body 20 to form a so called CRU (Customer Replaceable Unit), as shown in FIG. 2.

The process cartridge 40 has a construction in which a photoreceptor cartridge 100 having the photoreceptor drum 31 and a developer cartridge 120 having the developing device 34 as a cartridge are integrated. The process cartridge is freely attachable to and detachable from the main body 20 by opening a shutter cover 82 provided at the upper portion of the main body 20.

The photoreceptor cartridge 100 is supported by a pin to the developer cartridge 120 so as to be freely swung, and is pressed in a given direction with a bias spring.

Each of sub-cartridges (photoreceptor cartridge 100 and developer cartridge 120) constituting the process cartridge 40 will be described below.

The photoreceptor cartridge 100 comprises the photoreceptor drum 31, the charging device (charging roll) 32 for charging the drum, and the cleaning device (an embodiment comprising a cleaning blade 361 and a conveying paddle 362 in this example) 36 for cleaning the photoreceptor drum 31, housed in a cartridge case 101.

The photoreceptor drum 31 and charging device (charging roll) 32 are rotationally held in the cartridge case 101 via drum bearings and roll bearings (not shown), respectively.

The cleaning device 36 is composed of a part of the cartridge case 101 as a cleaning case, which comprises a cleaning blade 361 disposed in contact with the photoreceptor drum 31, provided at the edge of the cleaning case, and a conveying paddle 362 that conveys remaining toner scraped with a cleaning blade 361 provided in the vicinity of the opening of the cleaning case to the back of the cleaning case. The transferring paddle 362 is rotated through a paddle gear.

A peeling finger 105 for peeling a sheet is provided at a downstream of the transferring part.

The reference numeral 106 denotes a shatter and a shaft thereof for opening and closing the surface of the developing region, if necessary, of the photoreceptor drum 31 arranged in the cartridge case 101.

A developing method using a one-component developer method is employed, for example, in the developer cartridge 120 as a cartridge of the developing device 34. A cartridge case 121 comprises a development housing 122 (a second developer storage portion) and a toner feeding box 123 (a first developer storage portion). The region comprising the development housing 122 and toner feeding box 123 corresponds to a developer storage space.

A development roll 125 is disposed at a position facing the photoreceptor drum 31 of the development housing 122. A layer thickness-controlling blade 126 for controlling the thickness of the developer layer is provided around the developing roll 125, and a supporting agitator 127 for stirring the toner is further disposed at the back side of the developing roll 125. An agitator 128 for feeding the supplied toner to the developing roll is also provided at the back side of the developing roll.

A dispense auger 129 (a second stirring and conveying member) for uniformly feeding the toner supplied to the development housing 122 is disposed at the back side of the agitator 128 in the development housing 122.

A toner agitator 130 (a first stirring and conveying member) is provided, which delivers the supplied toner to the development housing 122 with stirring through a toner feeding duct 132 in the toner feeding box 123.

A scanning path 131 (an window) having, for example, a square cross section for permitting a scanning light from the exposing device 33 to pass through is open between the development housing 122 and toner feeding box 123 of the cartridge case 121 in the developer cartridge 120 as shown in FIG. 3. A toner feeding duct 132 (developer path) communicating between the development housing 122 and toner feeding box 123 is provided at both ends out of the scanning path 131 of the cartridge case 121.

Accordingly, the toner feeding box 123 is disposed at the upstream side (corresponds to an upper side in this example) of the latent image writing position P of the photoreceptor drum 31, and the development housing 122 is disposed at the downstream side (corresponds to a lower side in this example) of the latent image writing position P.

The toner agitator 130 (the first stirring and conveying member) disposed in the toner feeding box 123 comprises a shaft **130*a* and wire winding parts 130*b* having different winding directions with each other in the directions from the center of the axis direction to both ends of the shaft 130*a*. The shaft 130*a* and wire winding parts 130*b* are composed of a string of the wire. Accordingly, the developer stored in the toner feeding box 123 can be fed to the toner feeding ducts 132 at both sides in the axis direction as the toner agitator 130 rotates, and the developer is fed to the development housing 122 through the toner feeding duct 132**.

A dispensing auger 129 (the second stirring and conveying member) disposed in the development housing 122 comprises an axis **129*a* and screw shafts comprising screw portions 129*b* formed in different directions with each other from the end in the axis direction of the axis 129*a* to the center. A larger amount of the developer is delivered from the toner feeding ducts 132 at both sides to the center direction by allowing the dispensing auger 129 to rotate, and the developer is fed to the successive agitator 128** with uniform dispersion secured.

An operation of the image forming apparatus according to the embodiment of the invention will be described below.

A visible image (toner image) is formed using the developing device 34 after electrically charging the photoreceptor drum 31 employing the charging device 32, and forming a latent image on the photoreceptor drum 31 by the exposing device 33.

On the other hand, a sheet is delivered from the sheet feeding device 22 to the sheet conveying path 23 at a given timing, and travels to the transferring part after positioning the sheet with the resist roll 24.

The toner image on the photoreceptor drum 31 is transferred onto the sheet using the transferring device 35. After fixing the unfixed toner image on the sheet with the fixing device 25, the sheet on which the image has been fixed is discharged into the discharging tray 27. The remaining toner on the photoreceptor drum 31 is cleaned using the cleaning device 36.

In the imaging process as described above, since the scanning light emitted from the exposing device 33 arrives at the latent image writing position P of the photoreceptor drum 31 through the scanning path 131 of the process cartridge 40, there is no apprehension that the process cartridge 40 might affect a scanning ability of the exposing device 33.

While the development housing 122 of the developer cartridge 120 and the toner feeding box 123 are vertically separated with each other with interposition of the latent image writing position P of the photoreceptor drum 31, it is possible to supply the toner without impairing the scanning ability since they are communicating with each other through the toner feeding ducts 132 running around the scanning path 131.

While the toner is consumed while the imaging process is going on in the developing device 34 (developer cartridge 120), the toner in the toner feeding box 123 is conveyed to the dispensing auger 129 of the development housing 122 through the toner feeding duct 132 as described above, and is sequentially supplied to inside of the development housing 122 in accordance with rotating of the dispensing auger 129.

The fresh toner supplied to the development housing 122 is conveyed in a direction of the developing roll via the developing agitator 128, and is fed to the developing roll 125 side by being stirred using an auxiliary agitator 127. A thickness of the developer retained in the developing roll 125 is controlled to provide a given thickness using the layer thickness-controlling blade 126, and is fed to the development region between the development roll and photoreceptor drum 31. Thus, the toner is supplied in accordance with consumption of the toner.

Since the toner feeding box 123 is positioned above the latent image writing position P of the photoreceptor drum 31 in this embodiment, a position of the bottom of the process cartridge 40 may be lifted up to restrict a layout of the sheet feeding device 22 disposed at the bottom of the main body 20 to be removed.

Since the toner feeding box 123 is positioned at the upstream (upper side in this example) of the latent image writing position P of the photoreceptor drum 31 in this embodiment, the occupied space in the space above the scanning light line in the main body 20 increases. However, since the lower space of the discharging tray 27 in the main body 20 has inherently been a dead space which is only available for efficiently using it as the occupied space, the upper portion of the main body 20 is not required to be drastically changed.

In addition, there is no need for changing the upper portion (around the discharging tray 27) of the main body 20 if the upper space of the main body 20 is efficiently utilized, even when the supplying amount of the toner in the toner feeding box 123 is increased.

Accordingly, the main body 20 may be commonly used for constructing image forming apparatus having a variety of specifications. When the upper portion of the main body 20 is unavoidably changed, the portion may be slightly changed such that the position of the discharging tray 27 is slightly elevated.

The developer (toner) used in this embodiment will be described in detail below.

The developer for use in the invention has a compression ratio in the range of 0.30 to 0.40.

A compression ratio is an index of flowability of developer. The compression ratio G is expressed by $X=(Y-X)/Y$, wherein X is a nominal specific gravity of fully-packed toner, and Y is a nominal specific gravity of loosely-packed toner. The compression ratio is determined by use of a powder tester. A method for determining the compression ratio is described in Japanese Patent Application Laid-Open (JP-A) Nos. 2001-194823 and 2001-18387.

Use of the developer having the compression ratio in this range in the image forming apparatus (process cartridge) of this embodiment prevents excessive supplying of the developer from the first developer storage portion (toner feeding box 123) to the second developer storage portion (development housing 122), and prevents clogging of the developer path (toner feeding duct 132) due to blocking, thereby ensuring the developer to be stably fed.

A preferable range of the compression ratio of the developer is in the range of 0.32 to 0.38 for alleviating the problems to occur in the developing device. On the other hand, the developer with high fluidity having the compression ratio of lower than 0.30 is likely to flow from the first developer storage portion into the second developer storage portion, whereby a packing phenomenon readily takes place due to excessive supplying of the developer to the second developer storage portion. When the developer with poor fluidity having the compression ratio over 0.40, the developer hardly flows from the first developer storage portion into the second developer storage portion, whereby a so-called blocking phenomenon undesirably occurs due to clogging of the toner in the flow path.

The compression ratio of the developer may be controlled in the above range if the toner having an average particle diameter of 6 to 9 μm and including 5 to 25% of particles having a particle diameter of 4 μ or less is used, and further an inorganic metal oxide having a particle diameter of 0.02 μm or less is coated as an external additive at a coverage ratio of 60 to 95% of the surface area of the toner, although these conditions varies depending on the particle diameter of toner and the amounts of the magnetic material and releasing agent used.

As the toner particle diameter becomes larger, as the number of the particles having a particle diameter of 4 μm or less is decreased, as the amount of the magnetic powder is decreased and as addition amounts of the releasing agent and additive are increased, the compression ratio tends to be decreased, whereby these parameters must be adjusted suitably.

The compression ratio may be measured using, for example, a powder tester that is manufactured by Hosokawamicron Corporation.

The constituting elements of the developer are not particularly limited insofar as the developer includes the toner, and any conventionally known materials may be used for preparing the toner.

As the toner, a one-component magnetic toner containing a magnetic powder as a coloring agent is most preferably used. The magnetic powder to be dispersed in the binder resin include conventionally known magnetic materials such as metals such as iron, cobalt and nickel, and alloys thereof; metal oxides such as $Fe_3O_4$, γ-$Fe_2O_3$ and iron oxide supplemented with cobalt; various ferrites such as MnZn ferrite and NiZn ferrite; magnetite and hematite. These materials may be treated with a surface treating agent such as a silane coupling agent and titanate coupling agent, may be coated with an inorganic material such as silicon compounds and aluminum compounds, or alternatively may be coated with a polymer.

These magnetic powders may be mixed in a proportion ranging preferably from 35 to 55% by weight, and more preferably from 40 to 50% by weight, relative to a total amount of the toner particles. A binding force of the toner bearing body by magnetism may decrease when the proportion of the magnetic powder is less than 35% by weight, and the problems of scattering of the toner and fogging may sometimes occur. On the other hand, image density may decrease when the proportion of the magnetic powder exceeds 55% by weight. The magnetic powder having an average particle diameter of 0.05 to 0.35 μm is preferably used from the viewpoint of dispersability thereof in the binder resin. A nonmagnetic powder may occasionally be used simultaneously in order to adjust the coloring property.

An addition amount of these materials is in the range of 0.05 to 20% by mass, preferably 0.1 to 15% by mass, and more preferably 0.5 to 10% by mass, for obtaining the compression ratio of the developer in the above range, although it varies depending on the particle diameter of toner. The addition amount of less than 0.05% by mass is not preferable, since the particles are embedded in the surface of the developer due to an impact caused by stirring the developer to thereby fail in obtaining the effect of adding the particles. The addition amount exceeding 20% by mass is also not preferable, since the particles are separated from the toner and adhered to the developing roll to thus make it difficult to control charging.

The particles may be subjected to a treatment for imparting hydrophobicity so as to improve durability and fluidity. Such a hydrophobicity treatment is applied using an ordinary hydrophobic treatment agent.

Specific examples of the hydrophobic treatment agent include coupling agents such as a silane coupling agent, a titanate coupling agent, an aluminate coupling agent and a zirconium coupling agent, as well as silicone oil and polymer coating. These hydrophobic treatment agents may be used alone or in combination thereof.

It is preferable to use the silane coupling agents and silicone oil. Silane coupling agents of any type such as chlorosilane, alkoxysilane, silazane and special sililation agents may be used. Examples thereof include methyl trichlorosilane, dimethyl dichlorosilane, trimethyl chlorosilane, phenyl trichlorosilane, diphenyl dichlorosilane, tetramethoxy silane, methyltrimethoxy silane, dimethyldimethoxy silane, ethyltrimethoxy silane, propyltrimethoxy silane, phenyltrimethoxy silane, diphenyldimethoxy silane, tetraethoxy silane, methyltriethoxy silane, dimethyldiethoxy silane, ethyltriethoxy silane, propyltriethoxy silane, phenyltriethoxy silane, diphenyldiethoxy silane, butyltrimethoxy silane, butyltriethoxy silane, isobutyltriethoxy silane, hexyltrimethoxy silane, octyltrimethoxy silane, decyltrimethoxy silane, hexadecyltrimethoxy silane, trimethyltrimethoxy silane, hexamethyl disilazane, N,O-(bistrimethylsilyl)acetamide, N,N-bis(trimethylsilyl)urea, tert-butyldimethyl chlorosilane, vinyl trichlorosilane, vinyltrimethoxy silane, vinyltriethoxy silane, vinyltriacetoxy silane, γ-methacryloxypropyl trimethoxysilane, β-(3,4-epoxycyclohexyl)ethyltrimethoxy silane, γ-glycidoxypropyl trimethoxy silane, γ-glycidoxypropyl triethoxysilane, γ-glycidoxypropylmethyl diethoxysilane, γ-mercaptopropyl trimethoxysilane, and γ-chloropropyl trimethoxysilane; and fluorinated silane compound in which a part of hydrogen atoms in the silane compound above are substituted with fluorine atomes such as trifluoropropyl trimethoxysilnae, tridecafluorooctyl trimethoxysilane, heptadecafluoro trimethoxysilane, heptadecafluorodeyl methyldimethoxysilane, tridecafluoro-1,1,2,2-tetrahydrooctyl triethoxysilane, 3,3,3-trifluoropropyl trimethoxysilane, heptadecafluoro-1,1,2,2-tetrahydrodecyl triethoxysilane, and 3-heptafluoroisopropoxypropyl triethoxysilane; and aminosilane compounds in which a part of hydrogen atoms are substituted with amino groups. However, the silane coupling agent is not limited to the compounds described above.

Usable silicone oils include dimethyl silicone oil, methylhydrogen silicone oil, methylphenyl silicone oil, cyclic dimethyl silicone oil, epoxy-modified silicone oil, carboxyl-modified silicone oil, carbinol-modified silicone oil, methacryl-modified silicone oil, mercapto-modified silicone oil, polyether-modified silicone oil, methylstyryl-modified silicone oil, alkyl-modified silicone oil, amino-modified silicone oil, and fluorine-modified silicone oil. However, silicone oil is not restricted to those described above.

The charge amounts at a high humidity may be improved using the particles subjected to hydrophobicity treatment, whereby environmental stability due to charge amounts may be improved.

The method for subjecting the particles to hydrophobicity treatment include the methods known in the art, such as a method comprising the steps of: dropping or spraying a treatment agent diluted with a solvent such as tetrahydrofuran, toluene, ethyl acetate, methylethyl ketone and acetone into the particles vigorously stirred using a blender for thoroughly mixing; drying with heating after washing and filtering, if necessary; and pulverizing the aggregates after drying in a blender or mortar: a method comprising the steps of drying the particles after immersing them in a solution of the treatment agent, or dropping the solution of the treatment agent in an aqueous slurry of the particles, and drying with heating the precipitated particles followed by pulverizing: and a method comprising the steps of directly spraying the treatment agent onto the particles.

The adhering amount of the treatment agent onto the particles is preferably 0.01 to 50% by weight, and more preferably 0.1 to 25% by weight. The adhering amount may vary by increasing the mixing amount of the treatment agent in the treating step, or by changing the number of washing steps after the treatment. The adhering amount may be quantified by XSP and elementary analysis. Charge amounts may be decreased under a high humidity environment when the adhering amount of the treatment agent is too small. An excessive charge amount may occur or a released treating agent may deteriorate fluidity of the powder under a low humidity environment when the amount of the treating agent is too large.

Organic particles may also be added to the toner, in addition to the inorganic particles. Examples of the organic particles include particles of vinyl polymers such as styrene polymer, (meth)acrylic polymer and ethylene polymer; particles of other polymers such as ester, melamine, amide and allyphthalate polymers; particles of fluorinated polymers such as fluorovinylidene polymers; and particles of higher alcohols such as unilin. Particles having a primary particle diameter of from 0.05 to 7.0 μm are preferably used. The organic particles are usually added to the toner for improving cleaning ability and transferring ability.

The particles to be added to the toner may be slightly adhered or tightly adhered onto the surface of the toner particles by applying a mechanical impact force to the particles together with the toner particles using a sample mill or Henschel mixer.

The toner preferably contains a wax for improving offset resistance. Examples of usable wax include hydrocarbon wax such as low molecular weight polypropylene and low molecular weight polyethylene, microcrystalline wax, silicone resin, rosin, ester wax, rice wax, carnaubau wax, Fisher-Tropsch wax, montan wax and candellila wax.

Coloring agents may be added to the toner for controlling color tone. The coloring agent known in the art may be used without any limitation, and may appropriately be selected depending on the object. Examples of the coloring agent include carbon black, lamp black, DuPont oil red, orient oil red, rose Bengal, C.I. pigment red 5, 112, 123, 139, 144, 149, 166, 177, 178, 222, 48:1, 48:2, 48:3, 53:1, 57:1 and 81:1, pigment orange 31 and 43, quinoline yellow, chrome yellow, C.I. pigment yellow 12, 14, 17, 93, 94, 97, 138, 174, 180 and 188, ultramarine blue, aniline blue, carcoil blue, methylene blue chloride, copper phthalocyanine, C.I. pigment blue 15, 60, 15:1, 15:2 and 15:3, C.I. pigment green 7, malachite green oxalate, and nigrosine dye, which are previously dispersed by flushing. They may be used alone or in combination thereof.

Various additives may be added for controlling the charge amount. Additives such as fluorinated surfactants, salicylic acid complexes, iron-based dyes such as iron complexes, chromium-based dyes such as chromium complexes, macromolecular acids such as a copolymer containing maleic acid as a monomer component, quaternary ammonium salts and azin-based dyes such as nigrosine may be added in a range of 0.1 to 10.0% by weight. Addition of the charge controlling agent is not always necessary when the binder resin has a sufficient charge controlling function.

The toner may be produced according to conventionally known production methods. The production method is not particularly restricted, and may be selected depending on the object. Examples of the production method include kneading/pulverizing method, kneading/freezing/pulverizing method, dry-in-liquid method, shear-pulverization method by stirring the molten toner in a non-dissolving liquid, pulverizing method by jet-spraying after dispersing the binder resin and the coloring agent in a solvent, emulsion-aggregation method using a resin prepared by emulsion polymerization, suspension polymerization, and dissolution-suspension method. Preferably, the volume average particle diameter of the toner is about 5 to 15 μm.

The toner for use in the invention should have the charge amount in the range of −0.3 to −20.0 (μC/g) as measured by a suction method. High image density cannot be obtained when the charge amount is too low, while fogging increases when the charge amount is too high. The triboelectric measurement method by the suction method will be briefly described below. An exhaust port of a metal vessel having suction-exhaust ports and having a mesh with a pore size small enough to prevent the toner from passing through inside is connected to a vacuum pump. The vessel is also connected to a Coulomb meter, and the suction port is electrically insulated with a rubber cover. The toner on the toner bearing body is sucked simultaneously with evacuating operation, and the charge amount is measured with the Coulomb meter. The charge amount per unit weight can be measured by measuring a difference in a weight of the vessel before and after suction.

(B) Next, the image forming method according to the fourth aspect of the invention will be descried below.

In the image forming method according to the fourth aspect of the invention, a resistance value of toner measured under specific conditions should be adjusted to a given range.

The resistance value of toner has been usually measured by applying a voltage by positioning electrodes on the upper and lower surfaces of a press-molded toner pellet, followed by calculating the resistance value from the electric current flowing between the electrodes. However, this method was not satisfactory for estimating the transferring ability from the viewpoint that inflow and leakage of electrical charges on the surface of the developed toner particles cannot be taken into consideration since it is necessary to mold the toner, and that measuring sensitivity is so poor that different toners cannot be clearly distinguished due to too high an absolute resistance. The present inventors found that, considering the drawbacks described above, a minute difference of resistance among the toners can be detected by employing a resistance measuring method that has been used in the two-component developer system, wherein the magnetic toner is evaluated by the electrical resistance measured under the conditions applying electric currents using a magnetic brush. A small difference of the resistance can be detected, and hence the effect on the transferring ability of the toner can be estimated. The inventors also found that the problems involved in the prior art may be solved by specifying a resistance of the toner measured under the conditions within a given range.

The method for measuring the volume resistance of toner by applying an electric current using the magnetic brush according to the invention will be described hereinafter. The measuring method employed in the invention is the same as a volume resistance measuring method of the two-component developer as described in JP-A No. 2000-214637, which is applied for measuring the resistance of the one-component magnetic toner in the invention.

In the resistance measurement using the magnetic brush, aluminum pipes assuming to be photosensitive bodies are arranged to face with a given distance in the sleeve of a two-component developing unit, the developing unit is connected to the aluminum pipes through a power source and an ammeter, the developer is charged in the developing unit, a given voltage is applied from the power source after forming the magnetic brush on the sleeve, and the resistance is calculated from the electric current passed. Use of the magnetic brush enables to simultaneously measure the amount of the electric current within the toner and that on the surface of the toner, to thereby estimate inflow of electrical charges in the transferring process.

In the invention, the volume resistance was measured through the following procedure. 500 g of an Mn-mg ferrite core (manufactured by Powder Tech Co.), which had a particle diameter of 35 μm and was coated with 1% polystyrene resin and adjusted to $10^{10}$ to $10^{11}$ Ω·cm, was charged in a developing unit of A-color 630 copying machine (manufactured by Fuji-Xerox Co.), the sleeve is allowed to rotate for 7 minutes at 90 rpm for stabilizing the carrier layer, an amount of the carrier on the sleeve is adjusted to 50 mg/cm$^2$ using a partition plate, and the sleeve is allowed to further rotate for 30 seconds for stabilizing the carrier layer. Then, aluminum pipes having the same diameter as that of the photoreceptor of A-color 639 copying machine is arranged to face with the sleeve with a distance of 500 μm such that the layer structure of the carrier layer is not destroyed. The developing unit is connected to the aluminum pipes through an electrometer (trade name: KEITHLEY 610C manufactured by KEITHLEY Co.) and a high voltage power source (trade name: TREC MODEL 610C manufactured by TREC Co.).

A given quantity of a direct current voltage is applied to the sample prepared as above, and the resistance measured from the electric current after applying the voltage is multiplied by the sleeve length (cm), and the calculated value is recorded. The aluminum pipes are removed, and the sleeve is rotated again for another 30 seconds for stabilizing the carrier layer. The foregoing measurement is repeated, and a three point average values having a difference within 30% is defined as a resistance of the carrier under a given voltage.

The resistance at each voltage is measured by changing the applied voltage to 200 V, 300 V, 500 V, 800 V and 1000 V, and then 20 g of the toner is slowly supplied to the developing unit into which the carrier after measuring the resistance has been charged while rotating the sleeve at 90 rpm to prepare a developer having 4% by mass of the toner relative to the carrier (hereinafter abbreviated as TC). The sleeve is allowed to rotate for 7 minutes for stabilizing the magnetic brush on the sleeve. Thereafter, the resistance of the magnetic brush is measured by the same method as in the carrier, and the measured value is defined as a resistance of the toner at a TC of 4% by mass under a given voltage.

It is important in the invention that the volume resistance R (at an voltage of 500 V), when a direct current voltage of 500 V is applied by the magnetic brush, ranges from $1\times10^{15}$ Ω·cm to $5\times10^{16}$ Ω·cm at a TC content of 4% by mass. The transferring current is flew into toner in the transferring process from the latent image bearing body to the copying paper when the measured value is below $1\times10^{5}$ Ω·cm, and the transferring ability is deteriorated particularly at a process speed of 120 mm/s or less. On the other hand, deterioration of the developing ability, in particular occurrence of ghost and a decrease in development density, appears due to poor rise-up of charge amount when the volume resistance R at an applied voltage of 500 V is $5\times10^{16}$ Ω·cm or more, particularly at a process speed of 121 mm/s or more.

The toner having the aforementioned resistance may be obtained by improving dispersability of the materials added, particularly dispersability of the magnetic powder, while imparting electrical conductivity to the surface of the toner. The toner used in the invention is particularly excellent in fluidity since the surface thereof is covered with a composite oxide of iron and aluminum (hereinafter referred to as a composite iron oxide) and further the toner has high affinity with the binder resin due to the composite iron oxide layer. Accordingly, dispersability of the magnetic powder in the toner is excellent, and electrical charges may be prevented from flowing into the magnetic powder since a surface aluminum oxide has a higher electric resistance than iron oxide has.

In order to adjust the resistance within a desired range, it is preferable to enhance dispersability of the additive such as wax. For enhancing dispersability, optimization of the kneading condition, application of a surface treatment onto the magnetic powder, or addition of a dispersing auxiliary such as a polyolefin-grafted vinyl polymer is employed.

In order to impart electric conductivity to the surface of the toner, it is effective to utilize water absorbing property of polymers having polar groups, or to add a small amount of relatively low resistance additives such as titanium oxide.

In other words, the magnetic powder used in the invention acquires a higher electrical resistance than conventionally without incorporating any additive for improving dispersability in the resin while maintaining an appropriate electrical resistance. For obtaining a base toner having a high electrical resistance by employing the methods as described above, a relatively low resistance additive such as titanium oxide is added to the base toner. The one-component magnetic toner having a volume resistance R of from $1\times10^{15}$ Ω·cm to $5\times10^{16}$ Ω·cm at an applied voltage of 500 V may readily be prepared using the magnetic brush at a TC of 4% by mass.

The constituting elements of the magnetic toner used in the invention are not particularly limited, except that the magnetic powder having surface-coated with the composite oxide of aluminum and iron is used, and conventionally known materials may be used.

The magnetic powder usable for the one-component magnetic toner of the invention include well-known magnetic materials, for example metals such as iron, cobalt and nickel, and alloys thereof, metal oxides such as $Fe_3O_4$, $\gamma$-$Fe_2O_3$ and cobalt-added iron oxide, ferrites such as MnZn ferrite, NiZn ferrite, magnetite and hematite. However, the magnetic material having a composite iron oxide layer as the preferable magnetic material usable in the invention may be obtained, for example, by allowing a composite of aluminum oxide and iron oxide to precipitate on the surface of the magnetic powder in an aqueous media to thereby coat the surface of the magnetic powder with the composite oxide. The proportion of aluminum and iron in the composite oxide of iron and aluminum is represented by a molar ratio of the aluminum element to the iron element (Al/Fe), and the preferable ratio is $0.3 \leqq (Al/Fe) \leqq 3.0$, more preferably $0.5 \leqq (Al/Fe) \leqq 2.0$, and further preferably $0.6 \leqq (Al/Fe) \leqq 1.5$. A molar ratio of smaller than 0.5 is not preferable since fluidity of the magnetic powder is lowered to make it difficult to uniformly disperse the magnetic powder in the resin. A molar ratio exceeding 3.0 is also not preferable, since the composite oxide is not evenly coated on the surface of the magnetic material due to too large a proportion of aluminum, with a difficulty in controlling the electrical resistance of the magnetic material remained. The molar ratio of aluminum to iron may be determined by measuring the absorption peak of each element using, for example, an XPS apparatus.

The reason for obtaining improvement in the low speed transferring ability and image density in the high speed region, and decreased fogging using the magnetic material having the properties as described above is explained as follows. The resistance of the magnetic powder increases by forming a film of the composite oxide of aluminum and iron, and blackness of the image is not lowered since dispersability in the binder resin is excellent.

The magnetic powder is incorporated in an entire toner particles in a proportion ranges from 35 to 55% by mass, and preferably from 40 to 50% by mass. The binding force by magnetism of the toner bearing body is lowered when the content of the magnetic powder is less than 35% by mass, and the problems of scattering of the toner and increased fogging are caused. On the other hand, transferring ability is deteriorated at the low speed region by inflow of electrical charges due to a decrease in electrical resistance when the content of the magnetic powder exceeds 55% by mass, and the problem of a decrease in the image density is caused at an entire speed region. The magnetic powder having an average particle diameter of 0.15 to 0.35 μm is preferably used from the viewpoint of dispersability in the binder resin.

Any known resin may be used as the binder resin for preparing the toner usable in the invention. They are, for example, homopolymers or copolymers of at least one kind of vinyl monomers. Representative examples of the vinyl monomer include styrene, p-chlorostyrene, vinylnaphthalene; ethylenically unsaturated monoolefins such as ethylene, propylene, butylene and isobutylene; vinyl esters such as vinyl chloride, vinyl bromide and vinyl fluoride, vinyl acetate, vinyl propionate, vinyl benzoate, vinyl butylate, vinyl formate, vinyl stearate and vinyl caproate; ethylenic monocarboxylic acid and esters thereof such as methyl acrylate, ethyl acrylate, n-butyl acrylate, isobutyl acrylate, dodecyl acrylate, n-octyl acrylate, 2-chloroethyl acrylate, phenyl acrylate, methyl-α-chloro acrylate, methyl methacrylate, ethyl methacrylate and butyl methacrylate; substituted ethylenic monocarboxylic acid such as acrylonitrile, methacrylonitrile and acrylamide; ethylenic carboxylic acid and esters thereof such as dimethyl maleate, diethyl maleate and dibutyl maleate; vinyl ketones such as vinylmethyl ketone, vinylhexyl ketone and methylisopropenyl ketone; vinyl ether such as vinylmethyl ether, vinylisobutyl ether and vinylethyl ether; vinylidene halides such as vinylidene chloride and vinylidene chlorofluoride; and N-vinyl compounds such as N-vinylpyrrole, N-vinylcarbazole, N-vinylindole and N-vinylpyrrolidone. Styrene/acrylic acid copolymers and polyester resins, and mixtures thereof are preferably used by considering toner fixing property and storability.

The polyester resin is most preferable from the viewpoint of fixing ability in a high speed machine having a process speed of 180 mm/s or more.

Titanium oxide particles as an external additive should be added to the toner of the invention in a proportion of 0.5 to 1.0% by mass for controlling the surface resistance. The transferring efficiency particularly at the low speed region is largely lowered by adding the additive in a proportion of 1.0% by mass or more. On the other hand, the development ghost increases due to insufficiently controlled surface resistance when the addition amount is 0.5% by mass or less.

The primary particle diameter (average primary particle diameter) of the titanium oxide particles is preferably in the range of 0.03 to 0.1 μm, and more preferably of 0.04 to 0.07 μm.

Particles other than the titanium oxide particles are also preferably added to the toner of the invention for improving durability and fluidity of the powder. Examples of the inorganic particles to be added include, besides the titanium oxide particles, particles of metal oxides and ceramics such as silica, aluminum oxide, barium titanate, magnesium titanate, calcium titanate, strontium titanate, zinc oxide, silica sand, clay, mica, wollastonite, diatomaceous earth, cerium chloride, red iron oxide, chromium oxide, cerium oxide, antimony trioxide, magnesium oxide, magnesium carbonate, zirconium oxide, silicon carbide, silicon nitride, calcium carbonate and barium sulfate. The particles mainly containing silica and aluminum oxide particles are preferable among them. While these particles may be used alone or in combination thereof, the particles mainly containing silica are particularly preferable.

The hydrophobic treatment agent used for a treatment for imparting hydrophobicity to the inorganic particles are coupling agents such as silane coupling agents, titanate coupling agents, aluminate coupling agents and zirconium coupling agents as described above.

Organic particles may be added externally to toner, if necessary, for further improving cleaning ability and transferring ability of the toner used in the invention. Examples of the organic particles include vinyl copolymer particles such as styrene copolymer, (meth)acrylic copolymer and ethylene copolymer; and particles of various polymers such as ester, melamine, amide and allylphthalate polymers; fluorinated polymer particles such as polyvinylidene fluoride; and particles of higher alcohols such as Unilin (trade name). The preferably used particles have a primary particle diameter of 0.05 to 7.0 μm.

The particles added to toner are slightly or tightly adhered onto the surface of the toner particles by applying a mechanical impact on the particles together with the toner particles using a sample mill or Henschel mixer.

The toner for use in the invention preferably contains a wax for improving offset resistance. Examples of the wax used in the invention include hydrocarbon wax such as low molecular weight polypropylene and low molecular weight polyethylene, microcrystalline wax, silicone resin, rosin, ester wax, rice wax, carnaubau wax, Fisher-Tropsch wax, montan wax and candellila wax. The low molecular weight polypropylene and low molecular weight polyethylene, and carnaubau wax are preferably used among them from the viewpoint of dispensability in the resin, characteristics of the toner powder and productivity of the toner.

Various substances may be added for the purpose of controlling charges. For example, fluorine-type surfactants, salicylic acid complexes, iron-based dyes such as iron complexes, chromium-based dyes such as chromium complexes, macromolecular acids containing maleic acid as a monomer component, quaternary ammonium salts and azin-based dyes such as nigrosine may be added in the range of 0.1 to 10.0% by mass. A charge controlling agent is not required to be added when the binder resin has a sufficient charge controlling function.

Indene-type resins as described in JP-A No. 11-065161 may also be added to the toner. Preferably, copolymers of an indene-based monomer and a vinyl-based monomer having an aromatic ring are preferably used. These copolymers are usually added for improving a pulverizing ability of the toner.

Terpene-modified novolac resins described in JP-A No. 11-119462 may also be added to the toner. The resins are added for the purpose of improving image storability.

The toner used in the invention may be produced according to conventionally known production methods. The production method is not particularly limited, and may be appropriately selected depending on the object. While examples of the method include a kneading-pulverizing method, kneading/freezing/pulverizing method, dry-in-liquid method, shear-pulverization method by stirring the molten toner in a non-dissolving liquid, and pulverizing method by jet-spraying after dispersing the binder resin and coloring agent in a solvent, with the kneading-pulverizing method being preferable. The kneading-pulverizing method comprises melting and mixing a binder resin, coloring agent and other additives using a biaxial-type kneader such as a Bumbury kneader and extruder, pulverizing the mixture using a hammer mill and a jet pulverizer, and classifying with an inertia classifying machine to finally obtain the toner. These methods are excellent in producing the toner at a low cost while the additives can be internally added with relatively good dispersability.

The thus obtained toner preferably has a volume average particle diameter of 5 to 15 μm. Background fogging may undesirably increase when the average particle diameter is 5 μm or less, while image density is lowered when the average particle diameter is 15 μm or more.

EXAMPLES

The present invention is described in more detail with reference to the following examples, however, the invention is by no means restricted to these examples.

A particle size of a toner is measured using a particle size meter TA-II (manufactured by Beckman Coulter, Inc.) having an aperture with a diameter of 100 μm. A particle diameter of an external additive is determined by the scanning electron microscopic photographs. The compression ratio is measured using a powder tester (manufactured by Hosokawamicron Corporation). A molar ratio between aluminum and iron is measured using an XPS apparatus (manufactured by JEOL. Ltd.) in an argon atmosphere at an acceleration voltage of 10 kV and an electric current of 20 mA.

Example 1

Using a Henschel mixer, 51.25 parts by weight of a polyester resin (a cross-linked polyester mainly comprising bisphenol A/propylene oxide adduct and terephthalic acid, THF insoluble fraction 25%, MI=5.0, acid value=10.0, Tg=59.1° C.), 45.0 parts by weight of magnetite (saturated magnetization 82 $Am^2/kg$, remaining magnetization 5.5 $Am^2/kg$, coercive force 4.8 kA/m, @398 kA/m), 3.0 parts by weight of polypropylene wax (weight average molecular weight 3,000), and 0.75 parts by weight of a charge controlling agent (trade name: T-77, manufactured by Hodogaya Chemical Co., Ltd.) are mixed, and the resultant mixture is kneaded with heating using an extruder adjusted at a temperature of 150° C. After cooling, the kneaded mixture is crushed and pulverized followed by classification to obtain a classified toner having a volume average particle diameter of 6.5 μm and a proportion of the particles having a particle diameter of 4 μm or less of 20%.

To 100 parts by weight of the classified toner obtained by mixing with Henschel mixer are externally added 0.1 parts by weight of a hydrophobic titanium compound and 1.2 parts by weight of silicone oil-treated silica, and toner (developer) A is obtained by removing coagulates by sieving. As titanium oxide, irmenite is dissolved in sulfuric acid to separate an iron powder, and 5 parts of $SiCl_4$ is added to 100 parts of $TiOSO_4$ obtained. After hydrolysis, $TiO(OH)_2$ containing a Si component is obtained by washing with water. The obtained product is used without sintering. 5 parts of decyltrimethoxy silane and 5 parts of silicone oil is treated in a wet state to 100 parts of $TiO(OH)_2$. Then hydrophobic titanium oxide having an average particle diameter of 0.05 μm is obtained by drying and pulverizing using a jet mill. Silica used is silicone oil-treated silica having a primary particle diameter of 0.012 μm (trade name: RY200, manufactured by Nippon Aerosil Co., Ltd.). The compression ratio of toner (developer) A is 0.33.

Developer A prepared as above is charged in a developer storage space (a first developer storage portion and a second developer storage portion) of the process cartridge having the same construction as those in FIGS. 2 and 3. This process cartridge is attached in a laser printer DocuPrint 360 (having the same construction as in FIG. 1 and having been modified for use in the foregoing process cartridge) manufactured by Fuji Xerox Co., Ltd. The process cartridge is used for printing a pattern having a low image density with an image density of 1% and a pattern having a high image density with an image density of 20% until the charged toner is used up to thereby evaluate toner feeding performance, image density and fogging. The results are shown in Table 1.

The image density is measured using an X-rite densitometer, and the densities of 1.45 or more, 1.40 or more and less than 1.45, 1.35 or more and less than 1.40, and less than 1.35 are rated as ◎, ○, Δ and X, respectively. The image densities are evaluated under both high temperature/high humidity (H—H) conditions at 30° C. and 90% RH, and low temperature/low humidity (L—L) conditions at 10° C. and 15% RH.

Fogging is visually evaluated and rated as good (○), poor (X) and intermediate (Δ). The results are shown in Table 1.

Example 2

Toner (developer) B is obtained and evaluated by the same method as in Example 1, except that the addition amount of the magnetic powder is changed to 40% by weight, the addition amount of silicone oil-treated silica as the external additive is changed to 0.8 parts by weight, and the addition amount of the titanium compound is changed to 0.2% by weight. The compression ratio of toner B is 0.40. The results are shown in Table 1.

Example 3

Toner (developer) C is obtained and evaluated by the same method as in Example 1, except that the toner used has a volume average particle diameter of 8.8 μm having a proportion of the particle diameter of 4 μm or less of 10%, and the addition amount of silicone oil-treated silica as the external additive is changed to 1.5 parts by weight. The compression ratio of toner C is 0.30. The results are shown in Table 1.

Comparative Example 1

Toner (developer) L is obtained and evaluated by the same method as in Example 1, except that the amount of the magnetic powder is changed to 55% by weight, and the addition amount of silica as the external additive is increased to 1.8% by mass. The compression ratio of toner L is 0.28. The results are shown in Table 1.

Comparative Example 2

Toner (developer) M is obtained and evaluated by the same method as in Example 1, except that the amount of the magnetic powder is changed to 10% by weight, and the addition amount of silicone oil-treated silica as the external additive is changed to 0.3% by weight. The compression ratio of toner M is 0.52. The results are shown in Table 1.

TABLE 1

| | Toner | | Evaluation of Results | | | | | |
|---|---|---|---|---|---|---|---|---|
| | | | Low Image Density Printing | | | High Image Density Printing | | |
| | Kind | Compression Ratio | Image Density | Fogging | Toner feeding Performance | Image Density | Fogging | Toner feeding Performance |
| Example 1 | Toner A | 0.33 | Initial ◎ Continuous Printing ◎ | Initial ○ Continuous Printing ○ | No Problem | Initial ◎ Continuous Printing ◎ | Initial ○ Continuous Printing ○ | No Problem |
| Example 2 | Toner B | 0.40 | Initial ◎ Continuous Printing ◎ | Initial ○ Continuous Printing ○ | No Problem | Initial ◎ Continuous Printing ○ | Initial ○ Continuous Printing ○ | No Problem |
| Example 3 | Toner C | 0.30 | Initial ◎ Continuous Printing ○ | Initial ○ Continuous Printing ○ | No Problem | Initial ◎ Continuous Printing ◎ | Initial ○ Continuous Printing ○ | No Problem |
| Comparative Example 1 | Toner L | 0.28 | Initial Δ Continuous Printing X | Initial ○ Continuous Printing ○ | X Packing at second developer storage portion | Initials Δ Continuous Printing X | Initial ○ Continuous Printing ○ | No Problem |
| Comparative Example 2 | Toner M | 0.52 | Initial ○ Continuous Printing X | Initial Δ Continuous Printing X | X Blocking in developer path | Initial ○ Continuous Printing X | Initial Δ Continuous Printing X | X Blocking in developer path |

The results shown in Table 1 reveal that when the image forming apparatus is made compact in which a sufficient storage capacity of the developer is devised to provide developer storage spaces with interposition of the latent image writing position of the image bearing body, the toner can stably be supplied by designing the developer having a compression ratio in the range of 0.30 to 0.40. By adjusting the compression ratio within this range, low image density due to excessive supplying of the toner and toner packing due to too high fluidity can be avoided in case of low image density printing, and low image density caused by insufficient supplying of the toner due to poor fluidity can also be avoided in case of high image density printing.

The toner is produced and evaluated by the following method.

Production Example of Toner 1

Using a Henschel mixer, 48.0 parts by mass of polyester resin (cross-linked polyester mainly comprising bisphenol A/propylene oxide adduct and terephthalic acid, THF insoluble fraction 25%, MI=5.0, acid value=10.0, Tg=59.1° C.), 45.0 parts by mass of a magnetic powder mainly comprising magnetite and having a surface coated with a composite oxide of aluminum and iron (Al/Fe=0.82, primary particle diameter of magnetite base=0.20 μm, σs at 1 kOe=68.0 $Am^2/kg$), 3.0 parts by weight of polypropylene (trade name: P200, manufactured by Mitsui Chemicals, Inc.), 3.0 parts by mass of dispersion auxiliary (a copolymer resin obtained by polymerizing 65% of styrene, 5% of acrylonitrile, 10% of butyl acrylate, 15% of polypropylene wax and 5% of polyethylene wax), and 1.0 part by mass of charge controlling agent (trade name T-95 manufactured by Hodogaya Chemical Co., Ltd.) are mixed. The resultant mixture is kneaded with heating using an extruder adjusted at 150° C. After cooling, the kneaded mixture is crushed, pulverized and classified to obtained a classified toner (D50=6.5 μm, a proportion of particles having a particle diameter of 4 μm or less=20%).

To 100 parts by mass of the classified toner are externally added 0.8 parts by mass of hydrophobic titanium oxide and 1.2 parts by mass of silicone oil-treated silica, using a Henschel mixer. A toner is obtained after removing coagulates.

As titanium oxide, irmenite is dissolved in sulfuric acid and to separate an iron powder, and 5 parts of $SiCl_4$ is added to 100 parts of $TiOSO_4$ obtained. After hydrolysis, $TiO(OH)_2$ containing a Si component is obtained by washing with water. The obtained product is used without sintering. 5 parts of decyltrimethoxy silane and 5 parts of silicone oil is treated in a wet state to 100 parts of $TiO(OH)_2$. Then, hydrophobic titanium oxide having an average particle diameter of 0.05 μm is obtained by pulverizing with a jet mill after drying. Silica used is silicone oil-treated silica (trade name: RY200 manufactured by Nippon Aerosil Co., Ltd.) having a primary particle diameter of 0.012 μm. This silica is named as toner A. Toner A had a volume resistance R (500 V) of $3.5\times10^{15}$ Ω·cm as measured by the aforementioned method at a TC of 4% by mass.

Production Example of Toner 2

The toner is obtained by the same method as in Production Example of Toner 1, except that the addition amount of the magnetic powder is changed to 40% by mass and the addition amount of the titanium compound as an external additive is changed to 0.2% by mass. This toner is named as toner B. Toner B has a volume resistance R (500 V) of $2.0\times10^{16}$ Ω·cm as measured by the above method at a TC of 4% by mass.

Production Example of Toner 3

Toner C is obtained by the same method as in Production Example of Toner 1, except that the addition amount of the magnetic powder is changed to 30% by mass and the titanium compound is not added. Toner C had a volume resistance R (500 V) of $7.7\times10^{16}$ Ω·cm as measured by the above method at a TC of 4% by mass.

Production Example of Toner 4

Toner D is obtained by the same method as in Production Example of Toner 1, except that the addition amount of an ordinary magnetic powder not coated with a composite oxide of aluminum and iron is externally added in a proportion of 50% by mass and the titanium compound is added in a proportion of 1.0% by mass. Toner D has a volume resistance R (500 V) of $8.6\times10^{14}$ Ω·cm as measured by the above method at a TC of 4% by mass.

Example 4

Toner A is charged in a modified laser printer DocuPrint 210 (process speed: 90 mm/s, manufactured by Fuji Xerox Co., Ltd.), and the image density, development ghost and fogging by development are evaluated under the conditions of 10° C./15% RH (L—L) and the conditions of 30° C./80% RH (H—H).

Figure 4:
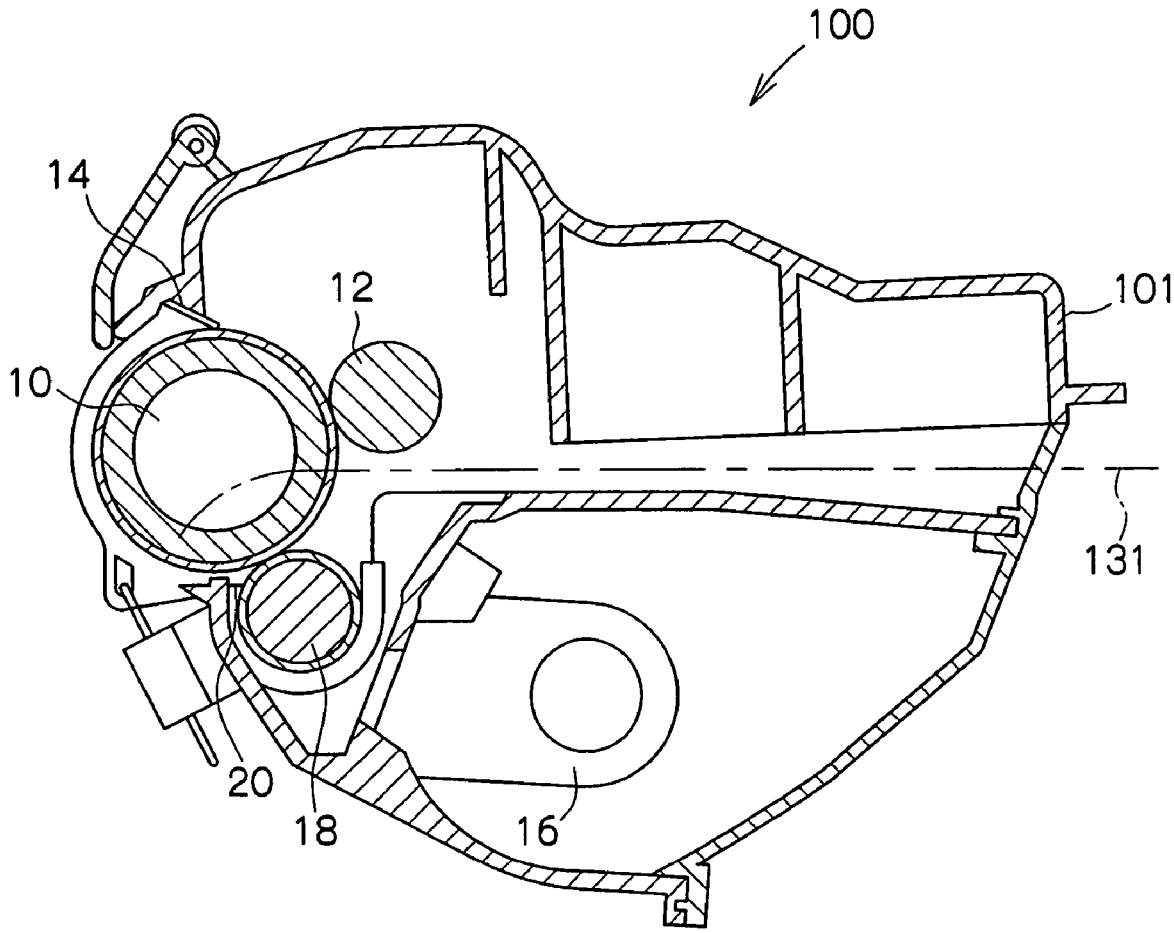
FIG. 4 is a schematic cross sectional view showing a photoreceptor cartridge portion of an image forming apparatus used in Example 4 of the invention.

The construction of the photoreceptor cartridge attached to the printer (image forming apparatus) is schematically illustrated in FIG. 4. As shown in FIG. 4, the photoreceptor cartridge 100 comprises an electrostatic latent image bearing body (photoreceptor drum) 10, a charging device (roller charging unit) 12 for charging of the latent image bearing body, and a cleaning device (blade-type cleaner in this example) 14 for cleaning the photoreceptor drum 10 housed in a cartridge case 101. The photoreceptor drum 10 and the roller charging unit 12 are independently held on the cartridge case 101 rotationally.

The one-component developer method is employed for the developer cartridge 16 in this example. The developer cartridge 16 has a function as a toner feeding box, and a developer supplying roller 18 is arranged at a position facing the photoreceptor drum 10 of the developer cartridge 16, while a layer thickness-controlling blade 20 for controlling a thickness of the developer layer is provided around the developer supplying roller 18.

A light scanning path 131 for passing a scanning light from the exposing device is open between the developer cartridge 16 and the roller charging unit 12 of the cartridge case 101 in this embodiment.

In this embodiment, the photoreceptor drum 10 is electrically charged using the roller charging unit 12, and the electrostatic latent image is formed on the photoreceptor drum 10 by scanning a laser beam. A thin layer of the toner is formed by the layer forming blade 20 in contact with the developer supplying roller 18, with a given linear pressure applied. The latent image is developed by simultaneously applying an alternate current voltage and a direct current voltage on the developing roller and developer supplying roller 18.

The photoreceptor cartridge 100 shown in FIG. 4 is arranged at a position where the photoreceptor drum 10 faces a roller transferring unit (not shown) in the image forming apparatus. The developed toner image is transferred onto an image receiving material such as a paper sheet using the roller transferring unit (not shown). Then, the roller transferring unit is cleaned with the blade-type cleaner.

Evaluation criteria are as follows:

The development ghosts which have a difference in density between a generated area and a non-generated area of less than 0.1, 0.1 to 0.15 and more than 0.2 are rated as ○, Δ and X, respectively.

Fogging and scattering at the background of the image are visually evaluated. A copying machine DocuCenter 400 (manufactured by Fuji Xerox Co., Ltd.) is used as a standard, and fogging and scattering on the image having a better level, an identical level and a poor level relative to the standard are rated as ○, Δ and X, respectively. The development ghost is evaluated under the (L—L) conditions, since ghost is liable to occur under these conditions.

Image densities are measured using an X-rite densitometer (manufactured by X-rite Co.), and densities of 1.45 or more, 1.40 or more and less than 1.45, 1.35 or more and less than 1.40, and less than 1.35 are rated as ◎, ○, Δ and X, respectively. The image density is evaluated under the (L—L) and (H—H) conditions.

Transferring ability is evaluated by calculating a transferring efficiency (%) via the following expression using an amount of the toner (mg/cm$^3$) developed on the photoreceptor and an amount of the toner (mg/cm$^3$) remaining on the photoreceptor after performing the transferring step:

Transferring Efficiency (%)=(an amount of the toner developed on the photoreceptor)−(an amount of the toner remaining on the photoreceptor after the transferring step)/(an amount of the toner developed on the photoreceptor)

The toners having the transferring efficiencies of 93% or more, 90% or more, 85% or more and less than 85% are rated as ◎, ○, Δ and X, respectively.

Example 5

The same evaluations as in Example 4 are performed, except that toner A is replaced by toner B. The results are shown in Table 2.

Comparative Example 3

The same evaluations as in Example 4 are conducted, except that toner A is replaced by toner C. The results are shown in Table 2.

Comparative Example 4

The same evaluations as in Example 4 are carried out, except that toner A is replaced by toner D. The results are shown in Table 2.

Example 6

The same evaluations as in Example 4 are performed, except that toner A is charged in the modified copying machine DocuCenter 402 (manufactured by Fuji Xerox Co.; process speed: 220 mm/s). The results are shown in Table 3.

Example 7

The same evaluations as in Example 6 are conducted, except that toner A is replaced by toner B. The results are shown in Table 3.

Comparative Example 5

The same evaluations as in Example 6 are carried out, except that toner A is replaced by toner C. The results are shown in Table 3.

Comparative Example 6

The same evaluations as in Example 4 are performed, except that toner A is replaced by toner D. The results are shown in Table 3.

TABLE 2

| Toner | Image Density (H—H) | Image Density (L—L) | Development Ghost (L—L) | Transferring Efficiency (H—H) | Transferring Efficiency (L—L) |
|---|---|---|---|---|---|
| Example 4 | ◎ | ◎ | ◎ | ◎ | ◎ |
| Example 5 | ◎ | ◎ | ◎ | ◎ | ◎ |
| Comparative Example 3 | ○ | X | ○ | ◎ | ◎ |
| Comparative Example 4 | ○ | ○ | ○ | X | Δ |

TABLE 3

| Toner | Image Density (H—H) | Image Density (L—L) | Development Ghost (L—L) | Transferring Efficiency (H—H) | Transferring Efficiency (L—L) |
|---|---|---|---|---|---|
| Example 6 | ◎ | ◎ | ◎ | ◎ | ◎ |
| Example 7 | ◎ | ◎ | ◎ | ◎ | ◎ |
| Comparative Example 5 | ○ | X | X | ◎ | ◎ |
| Comparative Example 6 | ◎ | ○ | ◎ | Δ | ◎ |

The results shown in Tables 2 and 3 reveal that images having high image density, less development ghost, excellent transferring efficiency and good image quality may be formed in a range from a low speed region obtained using a laser printer having a process speed of 90 mm/s to a high speed region obtained using a complex machine having a process speed of 220 mm/s in Examples 4 to 7, in which the image forming methods using the toners according to the invention are employed, irrespective of experimental environments (high temperature/high humidity to low temperature/low humidity environments), as compared to the results in Comparative Examples 3 to 6, in which the toners outside the range specified in the present invention are used.

As detailed above, the present invention can provide a process cartridge, an image forming apparatus and an image forming method that ensure a developer storage capacity without reducing a space for the developer in the developing device while providing both long life and a small apparatus size, and that can also maintain a stable image quality.

According to the method of the present invention, a composite iron oxide together with a specified metal is used as the magnetic powder in toner containing the binder resin and the releasing agent. The volume resistance is controlled within a specified range when the one-component magnetic toner prepared by controlling the particle size and the quantity of titanium oxide as an external additive is mixed with a carrier. Consequently, the present invention can provide an image forming method that exhibits a high transferring efficiency in a low process speed region as well as a high image density in a high process speed region without producing a development ghost, and that is employable in a wide region of from a low process speed to a high process speed, while achieving a high fixing ability.

What is claimed is:

1. A process cartridge being freely attachable to and detachable from a main body of an image forming apparatus, the process cartridge comprising a latent image bearing body and a developing device having a developer storage space for storing a developer, wherein the developer storage space is divided into a first developer storage portion and a second developer storage portion in a vertical direction such that a latent image writing position of the latent image bearing body is interposed between the first developer storage portion and the second developer storage portion, the first developer storage portion and the second developer storage portion communicate with each other through a developer path, and the developer has a compression ratio in a range of 0.30 to 0.40.

2. The process cartridge according to claim 1, wherein the developer has a compression ratio in a range of 0.32 to 0.38.

3. The process cartridge according to claim 1, wherein a toner included in the developer comprises a magnetic powder in an amount of 35 to 55% by mass.

4. The process cartridge according to claim 1, wherein a toner included in the developer comprises particles selected from the group consisting of silica, aluminum oxide and titanium oxide.

5. The process cartridge according to claim 1, wherein a toner included in the developer has a charge amount in a range of −0.3 to 20.0 (μC/g) as measured by a suction method.

6. An image forming apparatus comprising a main body and a process cartridge that is freely attachable to and detachable from the main body, the process cartridge comprising a latent image bearing body and a developing device having a developer storage space for storing a developer, wherein the developer storage space is divided into a first developer storage portion and a second developer storage portion in a vertical direction such that a latent image writing position of the latent image bearing body is interposed between the first developer storage portion and the second developer storage portion, the first developer storage portion and the second developer storage portion communicate with each other through a developer path, and the developer has a compression ratio in a range of 0.30 to 0.40.

7. The image forming apparatus according to claim 6, wherein the developer has a compression ratio in a range of 0.32 to 0.38.

8. The image forming apparatus according to claim 6, wherein a toner included in the developer comprises a magnetic powder in an amount of 35 to 55% by mass.

9. The image forming apparatus according to claim 6, wherein a toner included in the developer comprises particles selected from the group consisting of silica, aluminum oxide and titanium oxide.

10. The image forming apparatus according to claim 6, wherein a toner included in the developer has a charge amount in a range of −0.3 to −20.0 (μC/g) as measured by a suction method.

11. An image forming method comprising the steps of:

forming an electrostatic latent image on a surface of a latent image bearing body;

developing the electrostatic latent image with a developer in a developing device; and transferring a developed toner image onto a transfer body, wherein, in the developing device, a developer storage space is divided into a first developer storage portion and a second developer storage portion in a vertical direction, and the first developer storage portion and the second developer storage portion communicate with each other through a developer path, and wherein the latent image forming step comprises writing the latent image through a gap between the first developer storage portion and the second developer storage portion, and the developer has a compression ratio in a range of 0.30 to 0.40.

12. The image forming method according to claim 11, wherein the developer has a compression ratio in a range of 0.32 to 0.38.

13. The image forming method according to claim 11, wherein a toner included in the developer comprises a magnetic powder in an amount of 35 to 55% by mass.

14. The image forming method according to claim 11, wherein a toner included in the developer comprises particles selected from the group consisting of silica, aluminum oxide and titanium oxide.

15. The image forming method according to claim 11, wherein a toner included in the developer has a charge amount in a range of −0.3 to −20.0 (μC/g) as measured by a suction method.

* * * * *